US005749340A

United States Patent [19]

Warburton et al.

[11] Patent Number: 5,749,340

[45] Date of Patent: May 12, 1998

[54] HYDRAULIC TAPPETS

[75] Inventors: Alan Warburton, Steyning; Graham Atkin, Norwich, both of England

[73] Assignee: Ricardo Consulting Engineers Limited, West Sussex, England

[21] Appl. No.: 872,769

[22] Filed: Jun. 11, 1997

[30] Foreign Application Priority Data

Jun. 11, 1996 [GB] United Kingdom ..... 9612178

[51] Int. Cl.[6] ..... F01L 13/00; F01L 1/16; F01L 1/245

[52] U.S. Cl. ..... 123/90.16; 123/90.43; 123/90.49; 123/90.57

[58] Field of Search ..... 123/90.15, 90.16, 123/90.27, 90.36, 90.39, 90.41, 90.43, 90.44, 90.46, 90.48, 90.49, 90.55, 90.57

[56] References Cited

U.S. PATENT DOCUMENTS

| | | | |
|---|---|---|---|
| 3,678,906 | 7/1972 | Repko et al. | 123/90.49 |
| 4,546,734 | 10/1985 | Kodama | 123/90.43 |
| 4,869,215 | 9/1989 | Parsons | 123/90.16 |
| 5,002,022 | 3/1991 | Perr | 123/90.16 |
| 5,111,781 | 5/1992 | Kaku et al. | 123/90.16 |
| 5,419,290 | 5/1995 | Hurr et al. | 123/90.16 |

*Primary Examiner*—Weilun Lo

*Attorney, Agent, or Firm*—McAulay Fisher Nissen Goldberg & Kiel, LLP

[57] ABSTRACT

A hydraulic tappet comprises an open-ended cylinder and a piston slidably accommodated in the cylinder. One end of the piston projects out of the open end of the cylinder and engages a valve rocker. A gear mechanism is provide to effect rotation of the cylinder about its axis whilst the piston remains stationary. An oil chamber is provided within the cylinder beyond the other end of the piston. A pressurized oil space is arranged to supply oil to the chamber via a non-return valve. An oil discharge space communicates with the chamber via a pathway including an opening in the cylinder wall. The pathway is interrupted by the piston as the piston moves into the cylinder. The oil discharge space is at a pressure substantially below that of the pressurized oil space. A plurality of spaced holes is arranged in a spiral line formed in the cylinder wall but only one of the holes communicates with the oil discharge space at any one time.

5 Claims, 4 Drawing Sheets

HYDRAULIC TAPPETS

FIELD OF THE INVENTION

The present invention relates to hydraulic tappets for internal combustion engines.

DESCRIPTION OF THE PRIOR ART

As is well known, a tappet is essentially a device which contacts a valve actuator and may be adjusted to vary the clearance between the actuator and the associated valve stem. In practice, tappets are adjusted so that there is no clearance between the actuator and the valve stem. Traditionally, tappets were screw threaded in the nature of bolts and required periodic adjustment. More recently, hydraulic tappets have become widespread, that is to say tappets which comprise a piston which is urged against the valve rocker by a constant oil pressure, whereby no periodic adjustment is necessary.

It is known to be desirable under certain circumstances to vary the lift of an engine inlet valve, that is to say to vary the amount by which the inlet valve opens. It is also known to be desirable to vary the timing of an engine inlet valve, that is to say to vary the time at which the inlet valve opens or closes, e.g. in accordance with engine operating conditions. It is known to provide both of these desirable facilities by means of a modified hydraulic tappet.

Thus JP-A-61-025905 discloses a hydraulic tappet including a hollow piston with a hemispherical head which is in pivotal engagement with one end of a valve rocker. The piston is accommodated within a cylinder and an annular hydraulic supply space is provided around one end of the cylinder. The hydraulic space communicates with the interior of the piston through a hole in the wall of the cylinder and a further hole in the wall of the piston. The inner end of the wall of the piston has a hole which is normally closed by a non-return ball valve which is urged into the closed position by a spring in a chamber. A diagonal groove is formed in the outer surface of the piston and an oil release hole, which communicates with the annular hydraulic space, is formed in the wall of the cylinder. The piston is rotatable within the cylinder by means of a rack formed on its upper portion which is in mesh with a pinion whose rotation is controlled by the engine management system.

In use, when the diagonal groove is in alignment with the oil release hole, the piston can be moved inwardly into the cylinder by engagement with the rocker arm, whereby oil in the chamber is expelled into the annular hydraulic space. As the piston continues to move inwardly, communication of the diagonal groove with the oil release hole is interrupted and the piston can move no further. The position at which inward movement of the piston stops is thus determined by the rotational position of the piston.

Accordingly, when the lobe of the associated cam begins to act on and move the rocker, this movement is initially accommodated only by inward movement of the piston and the valve does not begin to open. However, at a longitudinal position of the piston determined by its rotational position in the cylinder, inward movement of the piston ceases and the action of the cam then results in opening of the associated valve. Accordingly, the time at which the valve opens may be varied by varying the rotational position of the piston. If the piston is positioned so that its opening is retarded by a certain amount its closing time is also advanced by the same amount.

The construction disclosed above has two major disadvantages. Firstly, the piston moves both longitudinally and rotationally in the cylinder. This means that the engaging surfaces of the rack and pinion act as a frictional restraint to longitudinal movement of the piston. Furthermore, oil that is displaced by movement of the piston is discharged into the pressurized gallery from which it was supplied. This means that the oil can necessarily be discharged at only a relatively slow rate because the pressure differential under which it is discharged is relatively low. Both of these factors result in a relatively low responsiveness of the tappet, that is to say the piston is able to move inwardly, only relatively slowly which means that the tappet is inherently unsuited for high speed operation.

Secondly, if the displacement of a valve that is being opened by a traditional cam is plotted against time, the resultant curve is substantially sinusoidal. This means that the speed of the valve as it begins to open is relatively low and subsequently increases and also that its speed is relatively low as it closes. However, the variable valve timing hydraulic tappet disclosed in JP-A-61-025905 effectively "chops off" the bottom portion of the sinusoidal lift curve of the valve at all times when the opening of the valve is retarded. The effect of this is that the valve opens at a higher speed than normal, which is of no consequence, and that the valve also closes at a higher speed than normal and thus hits against the valve seat with a greater force than normal. This not only generates additional noise but also substantially increases the wear of the valve and valve seat and thus decreases the service life of the engine.

It is therefore the object of the invention to provide a hydraulic tappet which may be used to vary the timing of an associated valve but which does not suffer from the disadvantages referred to above.

SUMMARY OF THE INVENTION

According to the present invention a hydraulic tappet of the type comprising an open-ended cylinder, a piston slidably accommodated in the cylinder, one end of the piston projecting out of the open end of the cylinder and being adapted to engage a valve actuator, means arranged to effect relative rotation of the piston and cylinder about the axis of the cylinder, an oil chamber within the cylinder beyond the other end of the piston, a pressurized oil space arranged to supply oil to the chamber via a non-return valve and an oil discharge space communicating with the chamber via a pathway including at least one opening in the cylinder wall, the pathway being arranged to be interrupted by the piston as the piston moves into the cylinder, is characterized in that the piston is rotationally fixed, that the means arranged to effect relative rotation of the speed and cylinder is arranged to rotate the cylinder, that the oil discharge space is at a pressure substantially below that of the pressurized oil space, preferably atmospheric pressure, and that a plurality of holes spaced apart in the longitudinal and peripheral directions is formed in the cylinder wall, whereby preferably only one of the holes communicates with the oil discharge space at any one time.

Thus in distinction to the construction disclosed in the prior document referred to above, the relative linear and rotational movements of the piston and cylinder are divided between them such that the piston moves only linearly but not in rotation and the cylinder moves in rotation. The means which effect the rotation of the cylinder thus do not impede the linear motion of the piston. In the construction of the prior document, oil is discharged from the chamber back to the pressurized oil space whereas in the construction of the present invention it is discharged back to a space whose pressure is substantially below that of the pressurized oil space. Both of these factors contribute to an increased responsiveness of the tappet and render the tappet suitable for high speed operation. The diagonal or spiral groove in the outer surface of the piston in the construction of the prior document is replaced by a plurality of holes arranged essentially in a spiral configuration in the cylinder wall. These are dimensioned and spaced such that control is provided of the communication with the oil discharge space.

Accordingly, in use, the cylinder is rotated until one or more of the holes in its wall are in communication with the oil discharge space and it is at the height of that hole which is furthest from the valve actuator that movement of the piston into the cylinder will cease when the lobe of the cam is acting on the valve actuator, whereafter further movement of the valve actuator will result in opening of the valve.

It is preferred that the cylinder is rotated by virtue of the provision on its periphery of an annular array of gear teeth in mesh with a movable rack. The rack will in practice be moved linearly by an actuator controlled by the engine management system.

The change to making the cylinder rotatable rather than the piston results in the internal construction of the tappet being rather simpler than in the construction of the prior document and it is in particular preferred that the pressurized oil space communicates with the chamber via an opening in the end wall of the cylinder and not via cooperating holes in the side walls of the piston and cylinder, as in the prior document.

The invention does of course also embrace an internal combustion engine of reciprocating piston type including one or more combustion spaces, each of which has one or more ports which may be selectively closed by respective valves which cooperate with respective valve actuators, each actuator being engaged by a tappet as described above. It is further preferred that the engine includes a hydraulic damper comprising a piston slidably received in an open-ended cylinder, one end of the piston projecting out of the cylinder, the piston being acted on by pressurized oil which biasses the said one end of the piston into contact with the valve actuator. The result of this is that as the valve actuator moves in one direction, and the valve opens, the oil pressure causes the piston to move out of the cylinder and follow the motion of the valve actuator and as the valve closes and the valve actuator moves in the opposite direction the piston is caused to move back into the cylinder against the pressure of the pressurized oil. This damper eliminates or substantially alleviates the problem referred to above of damage to the valve and the valve seat due to the "chopping off" of the lower portion of the lift curve of the valve when the engine is operated under conditions in which the opening of the inlet valves is retarded. This feature is of considerable importance to the functioning and service life of the engine and the present invention embraces the provision of such a hydraulic damper in connection with any engine whose inlet valves are operated by a variable valve timing device, particularly such a device of the type which operates by "chopping off" the lower portion of the e.g. sinusoidal lift curve of the valves and is thus subject to the wear problem referred to above.

Further features and details of the invention will be apparent from the following description of one specific embodiment which is given by way of example only with reference to the accompanying drawings, in which:

DESCRIPTION OF THE PREFERRED EMBODIMENTS

Figure 1:
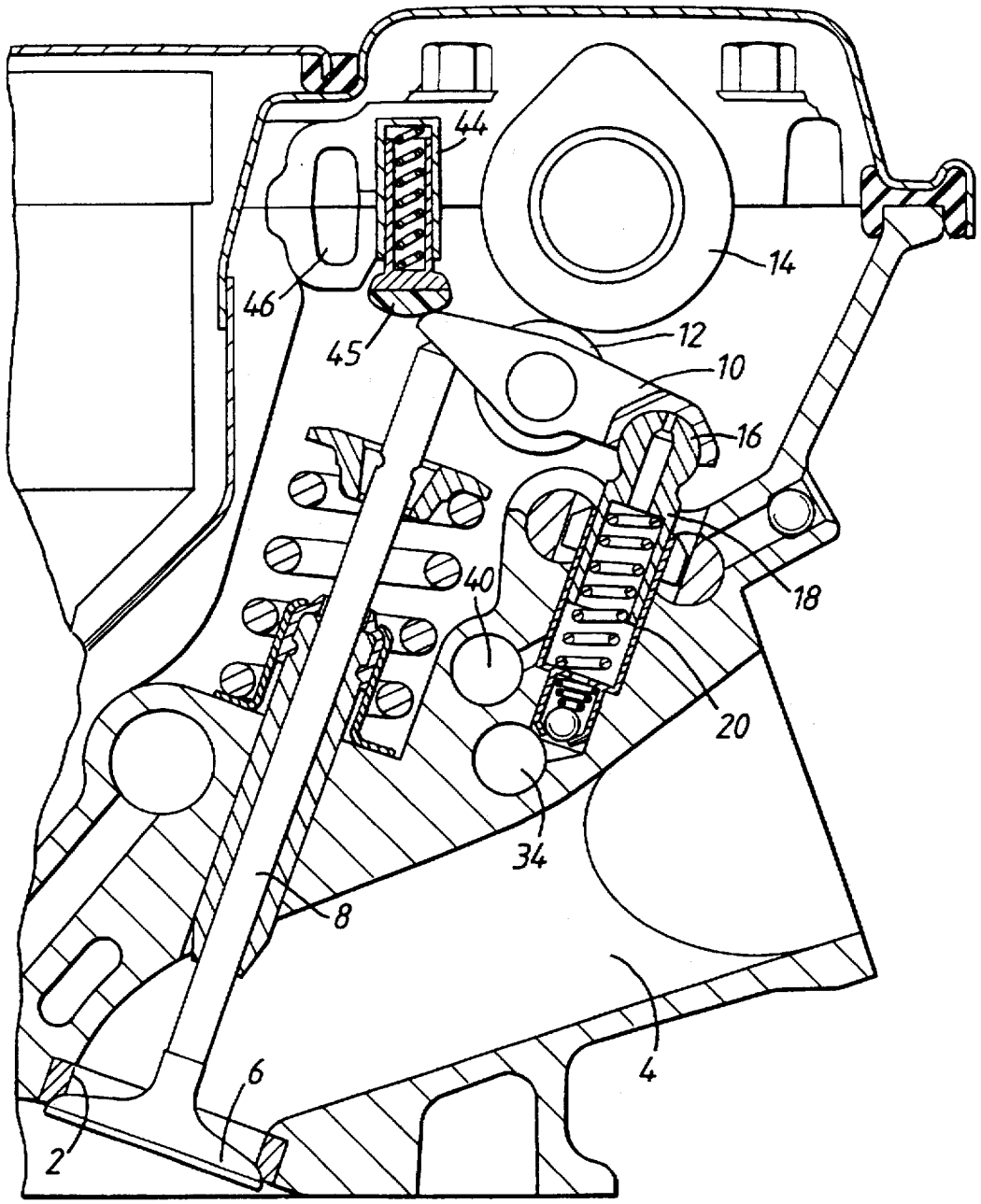
FIG. 1 is a scrap sectional view of part of an engine showing a single inlet valve and the associated valve rocker and tappet.

FIG. 1 shows a portion of an engine of reciprocating piston type including one or more combustion spaces, i.e. cylinders, in each of which a piston is reciprocably received and shows a single inlet port 2 which communicates with an inlet duct 4 and cooperates with an inlet valve comprising a valve head 6 adapted to form a seal with the valve seat constituted by the inlet port 2 and a valve stem 8. The free end of the valve stem 8 is engaged by one end of a valve actuator constituted by a rocker 10. The valve rocker 10 carries a projecting rotatable thrust roller 12 whose periphery is in constant rolling engagement with a cam 14. The other end of the valve rocker 10 affords a hemispherical recess in which the hemispherical head 16 of a tappet piston 18 is pivotably received.

The tappet piston 18 is slidably received in an open-ended tappet cylinder 20. The inner end of the piston 18 is hollow and thus in sleeve form and a spring 22 bearing against the floor of the cylinder acts on the underside of the piston head 16 to urge the piston 18 in the direction out of the cylinder. Formed in the floor of the cylinder is a central aperture 24 which communicates with a valve enclosure 26 in which a further aperture 28 is formed. Biassed into sealing contact with the margin of the aperture 28 by means of a spring 30 is a valve ball 32 which acts as a non-return valve. The aperture 28 communicates with a pressurized oil passage 34.

Formed in the side wall of the cylinder 20 is a row of holes 36 which extends in both the circumferential and axial directions. Communicating with one of the holes 36 is a passage 38 whose width in the circumferential direction of the cylinder is comparable to the diameter of the holes 36 and whose height in the axial direction of the cylinder is substantially greater than the diameter of the holes 36. The passage 38 communicates with an oil discharge passage 40 which is at low, e.g. atmospheric, pressure.

Formed on the exterior of the cylinder 20 is an annular array of gear teeth 42 constituting a pinion. These are in mesh with the teeth on a rack, as will be described in more detail below. The rack is linearly movable by means of an actuator (not shown) which is controlled by the electronic management system of the engine.

Figure 2:
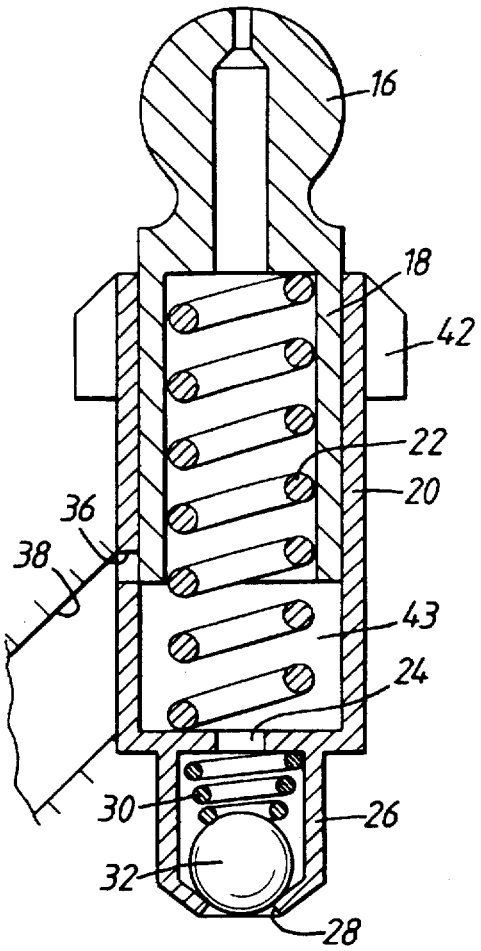
FIG. 2 is a diagrammatic axial sectional view of the tappet showing the cylinder in one extreme rotational position.
Figure 4:
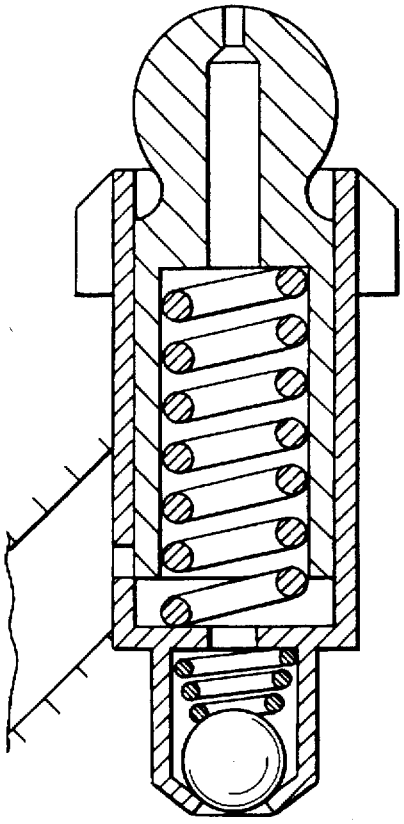
FIGS. 4 and 5 are views corresponding to FIGS. 2 and 3, respectively, showing the cylinder in the other extreme rotational position.
Figure 3:
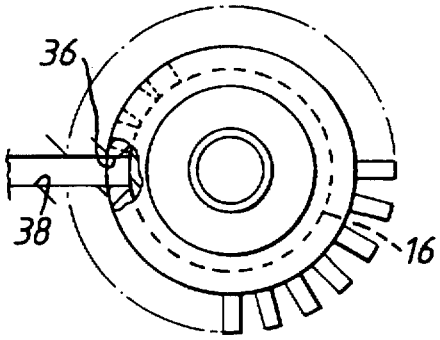
FIG. 3 is a diagrammatic transverse sectional view through the tappet in the position shown in FIG. 2.
Figure 5:
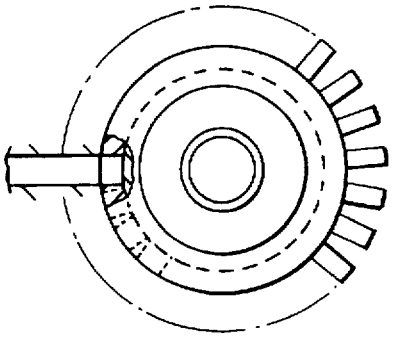
Figure 6:
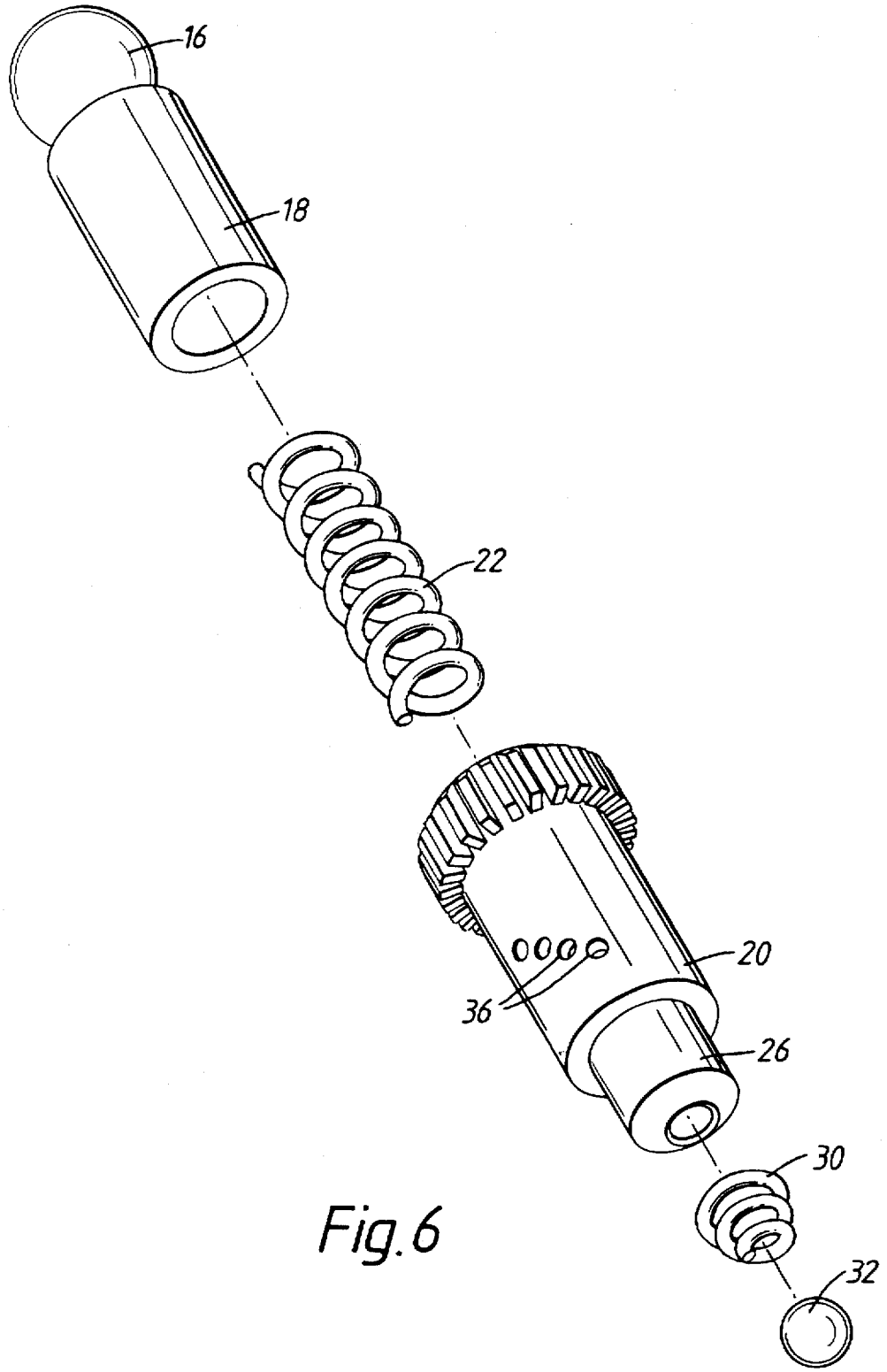
FIG. 6 is a perspective exploded view of the tappet.

In use, the cylinder 20 is rotated such that one of the holes 36 communicates with the discharge passage 38. The interior of the piston 18 and the chamber 43 defined at the lower end of the cylinder beneath the lower edge of the piston, as seen in FIGS. 2 and 4, are filled with oil which is admitted by the non-return valve 32 from the pressurized oil passage 34. As the cam 14 rotates and the cam lobe comes into contact with the roller 12, the rocker arm 10 begins to move downwardly, as seen in FIG. 1. This downward movement is initially accommodated only by movement of the piston 18 into the cylinder 20. This movement of the piston pressurizes the oil in the chamber 43 and this is discharged through the opening 36 which is in communication with the passage 38 and thence into the discharge passage 40. No oil is discharged back into the pressurized oil passage 34 since this is prevented by the non-return valve 32. Inward movement of the piston 18 continues until the lower edge of the piston moves over and thus seals the opening 36. Since the oil is essentially incompressible and there is now no route for it to escape from the chamber 43, inward movement of the piston ceases. The continuing downward movement of the valve rocker 10 is then accommodated by downward, that is to say opening, movement of the inlet valve 6, 8 which then permits air to flow through the inlet port 2 into the associated cylinder of the engine. When further rotation of the cam permits upward movement of the valve rocker, the inlet valve closes and the spring 22 then moves the piston 18 upwardly until it has returned to its initial position.

If it is desired to vary the time at which the inlet valve opens, the cylinder 20 is rotated in one or other direction to bring a different one of the holes 36 into communication with the discharge passage 38. Since all the holes 36 are at different longitudinal positions on the cylinder this will inherently result in movement of the piston 18 terminating at a different longitudinal position in the cylinder and thus in opening movement of the valve commencing earlier or later.

As mentioned above, if the opening time of the inlet valve is retarded, that is to say the bottom portion of the sinusoidal lift curse of the valve is "cut off" by appropriate rotation of the cylinder 20, there is a risk of damage to the valve head 6 and the valve seat 2 by the former hitting the latter at considerable speed. This risk is alleviated by the provision in accordance with the invention of a hydraulic damper comprising a damper piston 45 which projects out of an open-ended cylinder 44. The free end of the piston 45 is positioned to engage the same end of the valve rocker as that engaged by the valve stem 8 but on the opposite side. The interior of the cylinder 44 is acted upon by pressurized oil supplied from a pressurized oil passage 46. Accordingly, as the valve rocker moves downwardly, as seen in FIG. 1, the damper piston 45 follows it due to the action of the pressurized oil in the cylinder 44, though it is not essential that it do so. As the valve rocker moves upwardly again, it bears against the damper piston 45 and forces it back into the cylinder 44 against the pressure of the oil. The damping effect thus provided prevents the valve head 6 hitting against the valve seat 2 with considerable force and this damping action can be further promoted by providing the free end of the damper piston 45 with a resilient cushion of e.g. elastomeric material.

Figure 7:
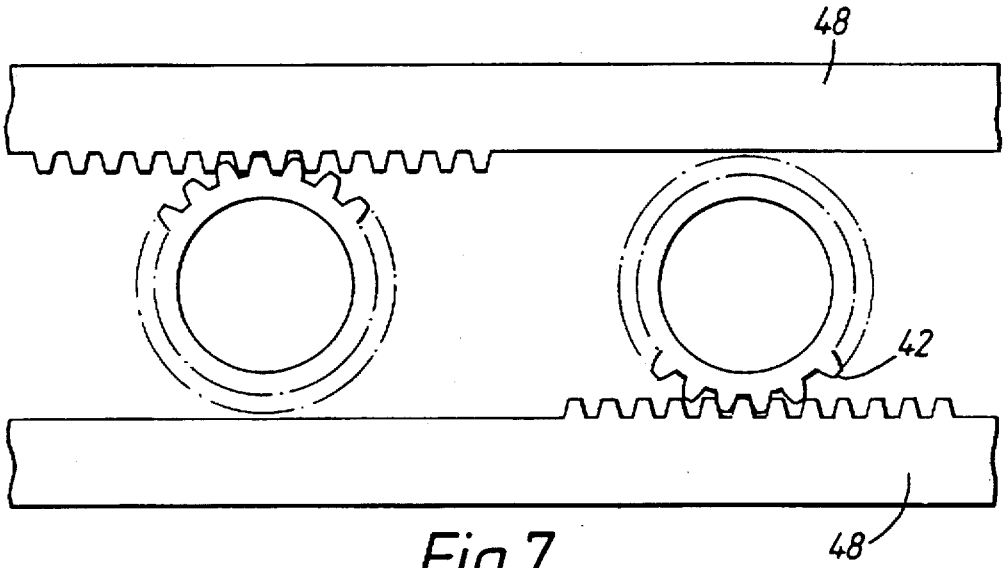
FIG. 7 is a diagrammatic plan view of one actuation system for rotating the cylinders of two or more tappets.

FIG. 7 shows one way in which the cylinders of two adjacent tappets may be rotated simultaneously. Their teeth 42 are in mesh with teeth on respective rack elements 48 which are moved linearly under the control of the engine management system. The two rack members 48 are on opposite sides of their associated cylinders 20 and thus if it is desired to rotate both cylinders 20 in the same sense, which is likely to be the case if the two tappets are associated with different cylinders of the engine, the two rack members 48 will be moved linearly in opposite directions. Alternatively, if the two tappets are associated with two valves of the same cylinder, it may be desired, for instance, to deactivate one valve entirely and this may render it desirable for the two tappets to be rotated in opposite directions. This may of course be achieved by moving the two rack members 48 in the same direction.

Figure 8:
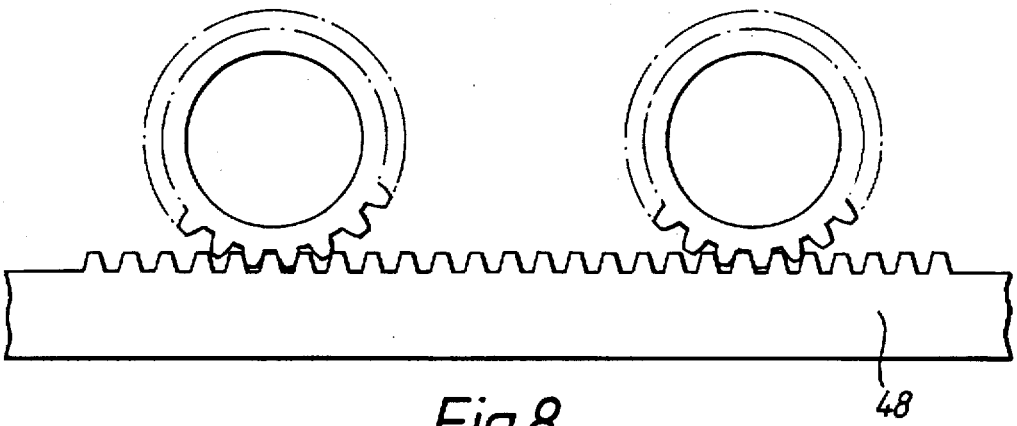
FIG. 8 is a view similar to FIG. 7 of an alternative method of actuation of the cylinders of two or more tappets.

An alternative possibility is shown in FIG. 8 in which the teeth on two or more cylinders 20 engage an elongate series of teeth on a single rack member. These cylinders will of course necessarily always be rotated in the same direction as a result of linear movement of the associated rack member.

Obviously, numerous modifications and variations of the present invention are possible in the light of the above teachings. It is therefore to be understood that within the scope of the appended claims, the invention may be practiced otherwise than as specifically described herein.

We claim:

1. A hydraulic tappet comprising:

a cylinder having a cylinder wall, an axis and two ends, one of said ends being open and the other one of said ends having an end wall;

a piston having two ends slidably accommodated in said cylinder, one of said ends projecting out of said open end of said cylinder and being adapted to engage a valve rocker;

means operatively associated with said cylinder to effect rotation of said cylinder relative to said piston about said axis of said cylinder, said piston being rotationally fixed;

said cylinder defining an oil chamber therein located beyond said other end of said piston;

said oil chamber being in communication with a pathway which communicates with a source of pressurized oil via a non-return valve to provide oil to said chamber;

said cylinder wall having a plurality of spaced holes arranged in line extending in the longitudinal and peripheral directions of said cylinder;

said oil chamber being in communication with an oil discharge pathway which includes one of said plurality of holes in said cylinder wall, only one of said holes communicating with said oil discharge pathway at any one time;

the flow of oil through said oil discharge pathway adapted to be interrupted by said piston as said piston moves into said cylinder to a position to seal the opening of said pathway; and said oil discharge pathway being at a pressure substantially below that of said pathway of pressurized oil.

2. A tappet as claimed in claim 1, wherein said cylinder wall has an annular array of gear teeth adapted to mesh with a movable rack.

3. A tappet as claimed in claim 1, wherein said cylinder end wall has an opening, said pathway of pressurized oil communicating with said cylinder oil chamber via said end wall opening.

4. An internal combustion engine of reciprocating piston type comprising:

a cylinder having an inlet port;

an inlet valve in said cylinder disposed for movement to selectively open and close said inlet port;

a valve rocker connected to said inlet valve in said cylinder for effecting movement of said inlet valve; and said valve rocker being operatively connected to a tappet as claimed in claim 1.

5. An internal combustion engine as claimed in claim 4, further comprising:

a hydraulic damper associated with said inlet valve of said cylinder, said damper defined by a piston slidably received in an open-ended cylinder;

said damper piston having two ends, one of said ends projecting out of said open-ended cylinder;

said damper piston being acted on by pressurized oil which biases said one end of said damper piston into contact with said valve rocker;

whereby as said valve rocker moves in one direction and said inlet valve opens, the pressurized oil causes said damper piston to move out of said open-ended cylinder, and as said inlet valve closes and said valve rocker moves in the opposite direction, said damper piston is caused to move back into said open-ended cylinder against the pressure of the pressurized oil.

* * * * *